US005366396A

United States Patent [19]

Schulze

[11] Patent Number: 5,366,396

[45] Date of Patent: Nov. 22, 1994

[54] WATER-JET DRIVE

[75] Inventor: Manfred Schulze, Melle, Germany

[73] Assignee: Jetmarine AG, Zug, Switzerland

[21] Appl. No.: 90,068

[22] PCT Filed: Dec. 10, 1992

[86] PCT No.: PCT/EP92/02852

§ 371 Date: Jul. 23, 1993

§ 102(e) Date: Jul. 23, 1993

[87] PCT Pub. No.: WO93/11998

PCT Pub. Date: Jun. 24, 1993

[30] Foreign Application Priority Data

Dec. 11, 1991 [DE] Germany ..... 4140881

[51] Int. Cl.[5] ..... B63H 11/00

[52] U.S. Cl. ..... 440/38; 440/83

[58] Field of Search ..... 440/1, 2, 38, 39, 40, 440/41, 42, 43; 415/129, 130, 131

[56] References Cited

U.S. PATENT DOCUMENTS

| | | | |
|---|---|---|---|
| 3,868,833 | 3/1975 | Noe et al. | 440/38 |
| 4,283,180 | 8/1981 | Rohner | 440/38 |
| 4,509,773 | 4/1985 | Wentworth | 415/131 |

*Primary Examiner*—Stephen P. Avila
*Attorney, Agent, or Firm*—McAulay Fisher Nissen Goldberg & Kiel

[57] ABSTRACT

A water-jet drive with a stator and a rotor enclosed by a housing having an inlet and an outlet nozzle, the rotor shaft which supports the rotor at one end and has torque-transmitting means at the other end being rotatably supported in the housing by shaft bearings arranged upstream and downstreams. A shaft bearing associated with the torque-transmitting means and supporting the rotor shaft is constructed so as to enable an axial displacement of the rotor shaft which can be adjusted via an external adjusting member.

8 Claims, 2 Drawing Sheets

WATER-JET DRIVE

BACKGROUND OF THE INVENTION

1. Field of the Invention

The invention relates to a water-jet drive with a stator and a rotor enclosed by a housing having an inlet and an outlet jet or nozzle in which the rotor shaft supporting the rotor is rotatably supported by shaft bearings arranged upstream and downstream.

2. Background of the Related Art

As is well-known, water-jet drives as well as known screw drives are produced as complete drive units, procured by shipbuilding yards, and connected with the finished boat hulls. For this purpose, suitable openings must be arranged in the lower stern or transom. When using jet drives, the base of the boat must also be constructed in such a way that space is allowed for the inlet duct.

For this purpose, as is shown e.g. in DE 21 52 308, the shaft bearing located upstream penetrates the wall of the boat to be connected with the jet drive, which wall forms part of the inlet duct, whereas the downstream shaft bearing is arranged in a hub of the part of the stator housing downstream of the rotor, the jet drive being formed by the stator.

According to FR 1 335 579, the jet drive is constructed in such a way that the inlet duct lies outside the hull of the boat so that openings for the shaft of the drive unit are only provided in the transom of the hull.

In order to allow shipbuilders also to perform such assembly work in a technically accurate and inexpensive manner, it is required that the drive unit be constructed in such a way that it can be connected with the ship hull in a simple and secure fashion so that required adjusting processes, particularly with respect to the driven rotor shaft, can be carried out in a reproducible manner at any time without great technical expense. This also applies particularly to boat hulls which are constructed as inflatable boats, since in this instance such jet drives are also assembled by persons lacking technical training.

As is well known, water-jet drives have a so-called pump with a stator and a rotor for accelerating and expelling the water required to produce propulsion. In such drives an exact adjustment of the gap between the conical housing or stator and the rotor is required so as to minimize so-called gap losses. The opposite defining surfaces of the housing or stator and rotor blades can be cylindrical and/or conical. Further, after longer operation of such pumps it is advantageous that the adjustment between the stator and rotor, also with respect to the housing, can be readjusted.

This adjustment or readjustment was formerly effected by means of spacer washers, e.g. between a stop on the rotor shaft and the rotor slid onto the rotor shaft so that the rotor to be driven could be adjusted relative to the housing and to the stationary stator. After inserting these spacer washers, the rotor shaft supported between two pivot bearings in the pump housing was defined in these pivot bearings in a fixed manner with respect to its axial adjustment.

An adjustment of the rotor relative to the conical housing by means of spacer washers is costly and difficult and requires specialized knowledge. In particular, time and labor must be expended for the above-mentioned readjustment of the rotor shaft, since the pump housing with the jet control arranged thereon must be extensively disassembled.

OBJECT AND SUMMARY OF THE INVENTION

The invention therefore has, as a primary object, the improving and constructing of known water-jet drives by enabling a simple assembly and adjustment of the rotor shaft.

This object is met according to the invention in that the bearing shafts supporting the rotor shaft are constructed so as to enable an axial displacement of the rotor shaft which is adjustable via an external adjusting member.

For this purpose, a pulley is associated with the rotor shaft as a means for transmitting torque and is freely rotatable on the rotor shaft and connected with the rotor shaft so as to be fixed with respect to rotation relative to it via a tooth coupling enabling axial motion of the rotor shaft.

According to another feature of the invention, the tooth coupling, which is connected with the rotor shaft in a positive-locking manner, is arranged in a mounting flange which is securely connected with the pulley and the mounting flange is securely connected with a covering cap which is penetrated centrically by a lockable adjusting member by which the rotor shaft can be axially displaced with respect to the pulley, and the pulley is supported on a bearing sleeve centrically penetrated by the rotor shaft so as to be rotatable but secured against axial displacement via ball bearings which are axially fixed on the bearing sleeve by means of spring rings, and the bearing sleeve has a bearing flange at its free end for a detachable connection with the transom of a watercraft.

A simple construction of the drive unit and adjustment thereof are achieved as a result of the inventive construction of the rotor shaft and its torque-transmitting members as a pulley. Further, the support of the drive shaft or rotor shaft according to the invention enables, within certain limits, an axial offsetting between the bearings on the drive side and those on the driven side, which has extremely advantageous results for assembly and operation, particularly in quasi-rigid watercraft such as inflatable boats.

In the following, the invention is described with reference to an embodiment example shown more or less schematically in the drawing.

DESCRIPTION OF THE PREFERRED EMBODIMENTS

Figure 1:
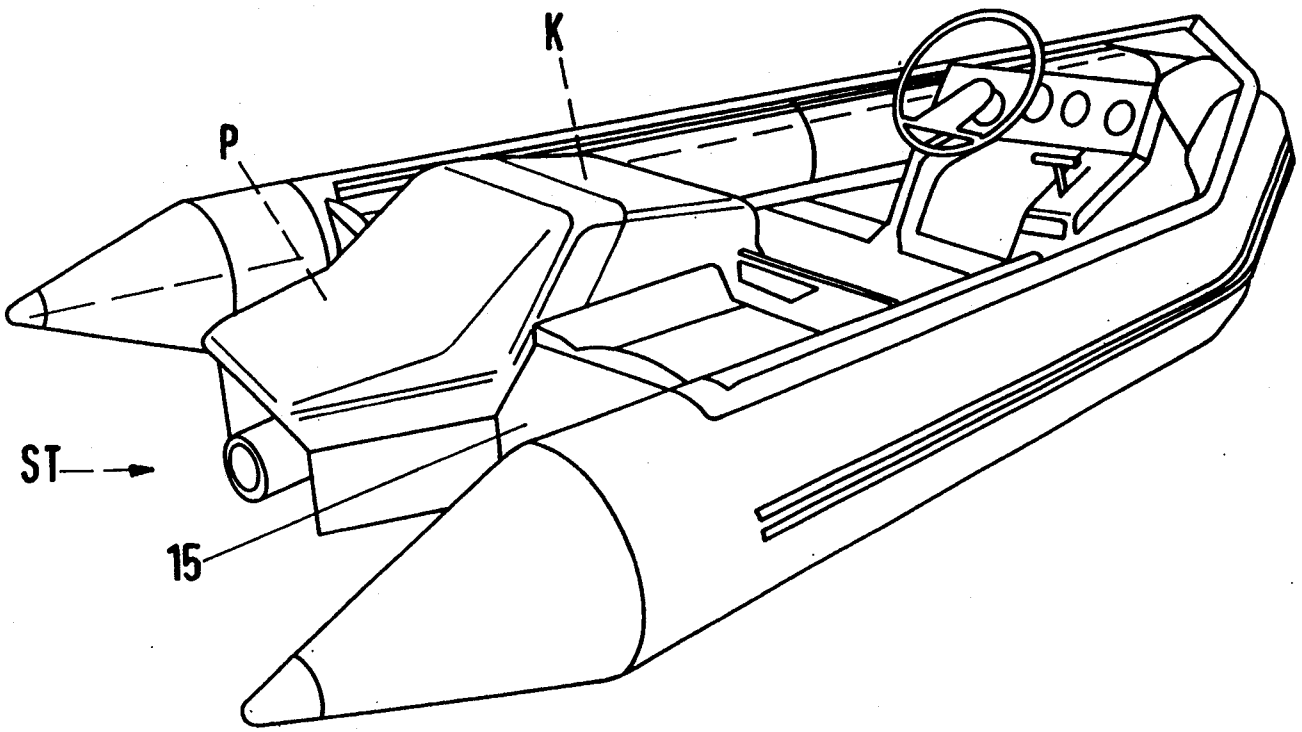
FIG. 1 shows a perspective view of a watercraft in the form of an inflatable boat with a water-jet drive.

A drive shaft 10 (see FIG. 2), also designated as rotor shaft in the following, penetrates a bearing sleeve 11 so as to be freely rotatable and displaceable in a reciprocating manner with axial play. The bearing sleeve 11 has a bearing flange 14 by which the bearing sleeve is rigidly attached to the transom 15 or to a mounting plate of the water-jet drive of a watercraft, which mounting plate is arranged at the end side and is not shown in the drawing. The bearing sleeve 11 is part of a power train K for the drive shaft 10 which will be described in the following.

The watercraft can be constructed as a boat or yacht or as an inflatable boat SB as shown in FIG. 1. In the latter case, the transom 15 is produced from wood or metal.

Figure 2:
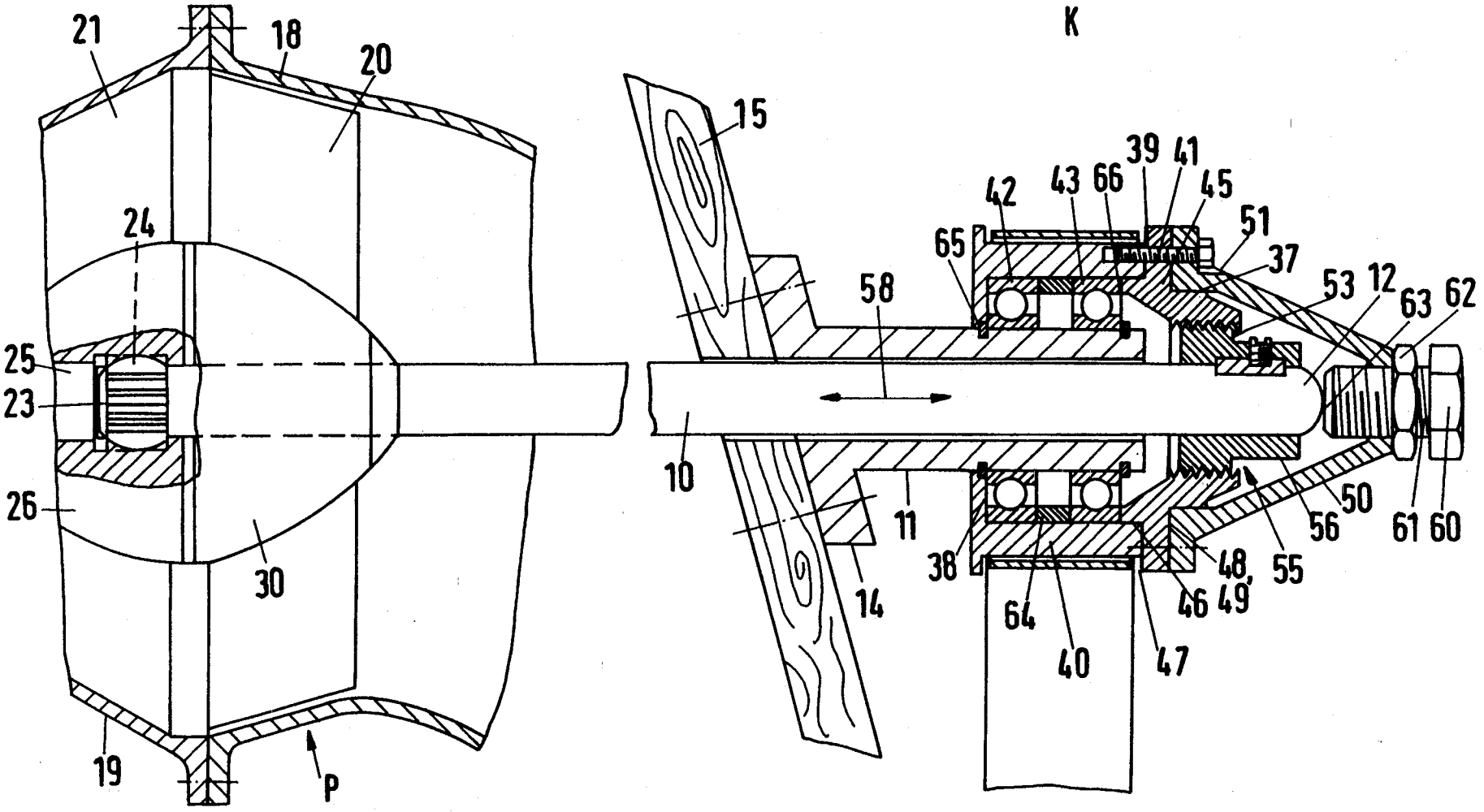
FIG. 2 shows a drive shaft according to the invention in section.

A water-jet drive ST, known per se, is associated with the watercraft SB, only its housing, which includes housing shells 18 and 19 which are screwed together, and the pump P enclosed by the housing are shown in FIG. 2. The pump P includes a rotor 20 associated with the drive shaft and a stator 21 rigidly connected with the housing shell 19. One free end 23 of the drive shaft 10 is rotatably supported in a swivel bearing 24 so as to be displaceable in a reciprocating manner to some extent. The swivel bearing 24 is arranged in a bearing opening 25 of the stator 21, while the other end of the drive shaft is rotatably supported in the power train. The rotor 20 with its hub 30 is connected with the drive shaft 10 so as to be fixed with respect to rotation relative to it.

The water entering through an inlet of the water-jet drive, not shown in the drawing, is accelerated by the pump P and exits via an outlet duct, also not shown, having a nozzle which is ordinarily constructed so as to be controllable and the water thus generates the desired propulsion for the watercraft.

The pump is driven via the power train K which has a pulley 40 with circular cross section serving to drive the drive shaft 10. A motor, e.g. a gasoline or diesel engine, which is not shown in the drawing is associated with the pulley via a toothed belt.

The pulley is rotatably supported on the outer surface area of the bearing sleeve 11 via two ball bearings 42 and 43 which are arranged at a distance from one another by means of a spacer ring 64 and are supported at a collar 38 of the pulley 40. The ball bearings are axially fixed via so-called spring rings 65 and 66 on the outer surface area of the bearing sleeve 11.

A mounting flange 45, which is substantially L-shaped in cross section, is connected to the opposite end 39 of the pulley 40 so as to be fixed but detachable, rests on the inner surface area of the pulley by a collar 46 and contacts the end side of the pulley with an end face 47. The end side 49 of a coupling cap 50, which is substantially shaped as a funnel in cross section, is connected with an opposite end face 48 of the mounting flange so as to be fixed but detachable and encloses a continuation 37 of the mounting flange 45.

The mounting flange 45 also has a portion 53 of a tooth coupling 55 in a central opening 51, the other portion 56 of the tooth coupling 55 being wedged on the facing end of the drive shaft 10.

In this way the drive shaft 10 is connected with the mounting flange 45, and accordingly with the pulley 40, so as to be fixed with respect to rotation relative to it but axially displaceable in the direction of arrow 58 with respect to the pulley. When the latter is driven, the mounting flange and coupling cap, and accordingly also the drive shaft, are rotated in the same direction.

The coupling cap 50 is penetrated centrically in the axial direction by an adjusting member in the form of an adjusting screw 60 which is adjustable likewise in the direction of arrow 58 via a threaded connection 61. The respective adjusting position can be fixed by means of a lock nut 62. The end side 63 of the adjusting screw 60 contacts the spherically constructed end side 12 of the drive shaft 10.

As follows from the preceding, the drive shaft 10 is supported in a twofold manner, namely at one end 23 by means of the swivel-sliding bearing 24 and at the opposite end by means of the power train K which includes the ball bearings 42 and 43 arranged on the bearing sleeve 11. The two bearings allow a limited displacement of the drive shaft 10 in the direction of arrow 58. Due to the mounting flange 45 which is securely connected with the pulley 40 on one side and with the coupling cap 50 via screws 41 on the other side and which is connected with the drive shaft 10 via a tooth coupling 55 so as to be fixed with respect to rotation relative to it, the drive movement transmitted to the pulley 40 is imparted to the drive shaft 10 and accordingly to the rotor 20 of the pump P via this tooth coupling.

The drive shaft 10 and accordingly the rotor 20 can be axially displaced or adjusted with respect to the stator 21 and housing via the adjusting screw 60. Since the coupling cap 50 is securely connected with the pulley 50 by means of the screws 41, the adjusting screw 60 revolves synchronously with the pulley 40 and accordingly with the drive shaft 10 so that no relative movement can occur between the mutually facing ends of the adjusting screw 60 and drive shaft 10. Since the adjusting screw 60 faces into the interior of the watercraft with reference to the transom 15, the drive shaft 10 and accordingly the rotor 20 can be adjusted relative to the stator 21 and the housing from the interior of the watercraft, that is, without disassembling the power train or housing.

If a curved-tooth coupling, also known as a Bowex coupling, is used as tooth coupling a swiveling of the drive shaft 10 is also possible within limits at the bearing K. In this way an offsetting between the bearings K and 24 can be safely controlled and will not interfere with operation.

While the foregoing description and drawings represent the preferred embodiments of the present invention, it will be obvious to those skilled in the art that various changes and modifications may be made therein without departing from the true spirit and scope of the present invention.

What is claimed is:

1. A water-jet drive comprising:

a housing having an inlet and an outlet nozzle;

a stator and a rotor enclosed by said housing;

a shaft for supporting and rotating said rotor, said shaft being positioned in an aperture in a boat transom and being rotatable therein;

first and second shaft bearings arranged upstream and downstream of the boat transom, respectively for rotatably supporting said shaft, said shaft bearings being constructed so as to enable axial displacement of said rotor shaft, said first shaft bearing being fixed with respect to the transom and said second shaft bearing being positioned within said housing; and an external adjusting member for adjusting the axial displacement of the rotor shaft.

2. A water-jet drive according to claim 1, wherein a pulley is associated with the rotor shaft as a means for transmitting torque and is freely rotatable on the rotor shaft and is connected with the rotor shaft so as to be fixed with respect to rotation relative to it via a tooth coupling enabling axial movement of the rotor shaft.

3. A water-jet drive according to claim 2, wherein the tooth coupling which is connected with the rotor shaft in a positive-locking manner is arranged in a mounting flange which is securely connected with the pulley, and in that the mounting flange is securely connected with a covering cap which is penetrated centrically by a lockable adjusting member by which the rotor shaft can be axially displaced with respect to the pulley.

4. A water-jet drive according to claim 3, wherein the mounting flange is substantially L-shaped in cross section and has a collar at one side which corresponds to the inner surface area of the pulley and a continuation at the remote side which is enclosed by a fitting surface of a coupling cap whose end on the base side corresponds with a fitting surface of the mounting flange, and in that the mounting flange and coupling cap are securely connected with one end of the pulley by screws.

5. A water-jet drive according to claim 3, wherein the mounting flange carries the tooth coupling in an end opening, one coupling part of the latter being wedged with the rotor shaft so as to be fixed with respect to rotation relative to it.

6. A water-jet drive according to claim 1, wherein an opposite end of the rotor shaft is supported by means of a swivel bearing so as to be rotatable and movable in a reciprocating manner, the swivel bearing being arranged in a bearing opening of the bearing body of the stator.

7. A water-jet drive according to claim 2, wherein a curved-tooth coupling is used as said tooth coupling.

8. A water-jet drive comprising:

a housing having an inlet and an outlet nozzle;

a stator and a rotor enclosed by said housing;

a shaft for supporting and rotating said rotor, said shaft being positioned in an aperture in a boat transom and being rotatable therein, first and second shaft bearings arranged upstream and downstream of the boat transom, respectively for rotatably supporting said shaft, said shaft bearings being constructed so as to enable an axial displacement of said rotor shaft, said first shaft bearing being fixed with respect to the transom and said second shaft bearing being positioned within said housing; and an external adjusting member for adjusting the axial displacement of the rotor shaft;

a pulley associated with the rotor shaft as a means for transmitting torque, said pulley being freely rotatable on the rotor shaft and connected with the rotor shaft so as to be fixed with respect to rotation relative to said rotor shaft using a tooth coupling enabling axial movement of the rotor shaft;

said tooth coupling which is connected with the rotor shaft in a positive-locking manner being arranged in a mounting flange which is securely connected with the pulley, said mounting flange being securely connected with a covering cap which is penetrated centrically by a lockable adjusting member by which the rotor shaft can be axially displaced with respect to the pulley; and said pulley being supported on a bearing sleeve so as to be rotatable but secured against axial displacement using ball bearings which are axially fixed on the bearing sleeve by means of spring rings, the bearing sleeve being centrically penetrated by the rotor shaft with axial play, and in that the bearing sleeve has a bearing flange at its free end for a detachable connection with the stationary portion of a watercraft.

* * * * *